US005167162A

United States Patent [19]

Nagashima et al.

[11] Patent Number: 5,167,162

[45] Date of Patent: Dec. 1, 1992

[54] STARTER SYSTEM FOR AN INTERNAL COMBUSTION ENGINE

[75] Inventors: Shinichi Nagashima; Hitoshi Ono, both of Tochigi; Shigeki Miyazaki, Gumma; Kazuhiro Yamamoto, Gumma; Eiichi Kimura, Gumma, all of Japan

[73] Assignee: Mitsuba Electric Manufacturing Co., Ltd., Gumma, Japan

[21] Appl. No.: 703,548

[22] Filed: May 21, 1991

[30] Foreign Application Priority Data

May 22, 1990 [JP] Japan ..... 2-131631
Jun. 1, 1990 [JP] Japan ..... 2-058332[U]
Jun. 1, 1990 [JP] Japan ..... 2-058333[U]

[51] Int. Cl.[5] ..... F02N 15/06

[52] U.S. Cl. ..... 74/7 A; 74/7 C; 74/7 E

[58] Field of Search ..... 74/7 R, 7 A, 7 C, 7 E

[56] References Cited

U.S. PATENT DOCUMENTS 4,507,978 4/1985 Tanaka et al . ..... 74/7 E
4,510,406 4/1985 Morishita ..... 74/7 E X
4,520,285 5/1985 Isozumi et al. ..... 74/801 X
4,528,470 7/1985 Young et al. ..... 310/78
4,561,316 12/1985 · Bolz et al. ..... 74/7 E
4,573,364 3/1986 Givan ..... 74/7 E
4,604,907 8/1986 Morishita et al. ..... 74/7 E
4,779,470 10/1988 Morita et al. ..... 74/7 R
4,881,416 11/1989 Isozumi ..... 74/7 E X
4,895,035 1/1990 Okamoto et al. ..... 74/7 A
4,899,604 2/1990 Morishita et al. ..... 74/7 E X
4,912,992 4/1990 Kinoshita ..... 74/7 A
5,052,234 10/1991 Sugiyama ..... 74/7 R X

FOREIGN PATENT DOCUMENTS 59-221463 12/1984 Japan .

*Primary Examiner*—Allan D. Herrmann
*Attorney, Agent, or Firm*—Skjerven, Morrill, MacPherson, Franklin & Friel

[57] ABSTRACT

In a starter system for an internal combustion engine, an input member of an overrunning clutch is provided with an annular shoulder surface abutting an annular end surface of a cylindrical boss portion of a reduction gear unit casing when the overrunning clutch is at a rest position, and a cylindrical sleeve portion extends from the annular shoulder surface towards the reduction gear unit so as to be closely fitted on the cylindrical boss portion of the reduction gear unit casing. Thus, water and other foreign matters are not only shut off by these mutually abutting annular surfaces, but also prevented from reaching this region by the cylindrical sleeve portion closely fitted on the cylindrical boss portion of the reduction gear unit. Also, the centrifugal force prevents water and other foreign matters from reaching this area when the starter is actuated and the two annular surfaces are not in contact.

9 Claims, 3 Drawing Sheets

STARTER SYSTEM FOR AN INTERNAL COMBUSTION ENGINE

TECHNICAL FIELD

The present invention relates to a starter system for an internal combustion engine, and in particular to an improved starter system which can prevent intrusion of water and other foreign matters into an overrunning clutch, a spline coupling portion, a reduction gear unit and other parts thereof.

BACKGROUND OF THE INVENTION

Conventionally, various starters for cranking an internal combustion engine have been known. Typically, in such a starter, as disclosed in Japanese patent laid open publication No. 59-221463, and U.S. Pat. Nos. 4,604,907, 4,561,316, 4,573,364, 4,520,285, 4,510,406, and 4,528,470, a pinion is selectively meshed with a ring gear or an internal gear of the engine to crank the same according to the on-off action of an electromagnetic switch by way of a one-way clutch or an overrunning clutch which is driven by a DC motor via a planetary gear reduction unit.

Since the starter includes various mechanical components—such as a spline coupling portion, an overrunning clutch and a reduction gear unit—which are sensitive to moisture and contamination, the starter is desired to be equipped with structures for keeping off water and dust. In the conventional starter, the drive shaft and the input member of the overrunning clutch are coupled to each other via a spline coupling portion, and the overrunning clutch can reciprocate axially according to the on-off action of the starter while transmitting rotational torque from the reduction gear unit to a drive pinion. The rest position of the overrunning clutch when the starter is not operating is typically defined by the abutment of an end portion of the spline groove on the drive shaft with an axial end of the spline teeth of the input member of the overrunning clutch, and this abutting engagement of the two parts is not capable of effectively shutting off water and dust. Therefore, there was a possibility of intrusion of water and dust into the spline coupling portion from the gaps of the spline teeth.

U.S. Pat. No. 4,561,316 discloses an annular end surface of the input member of its overrunning clutch abutting an end surface of a reduction gear unit by way of a brake washer 58. However, there is no mentioning of the capability of the brake washer to function as a sealing element. Furthermore, when the starter is activated, the two parts are quickly moved away from each other, and water and other foreign matters can easily pass through the gap between these two parts.

Further, since it is not always possible to keep water completely out of the housing accommodating the internal gear, the casing of the starter which communicates with the interior of the housing is provided with a water draining hole which faces outside of the engine when the starter is mounted on the engine. Also, in the conventional starter, the mounting flange is provided in a base end of its cylindrical mounting portion, and the water draining hole opens externally of the mounting surface of the engine associated with the mounting flange. Therefore, water splashed up by the vehicle during its motion may enter the interior of the starter through this water draining hole.

In such a starter, the pinion is integrally formed in the output member of the overrunning clutch constructed as a clutch inner member, and, if the water which, for instance, may have reached the interior of the starter from the side of the ring gear of the engine adheres to the pinion or a part of the clutch output member adjacent the clutch input member, there is a chance that the water may enter the interior of the clutch from a gap defined between a clutch cover integrally attached to the clutch outer member and the clutch inner member. Thus, such an intrusion of water should be avoided as much as possible.

BRIEF SUMMARY OF THE INVENTION

In view of such problems of the prior art, a primary object of the present invention is to provide a starter system for an internal combustion engine which can improve the capability to keep off water and dust from the spline coupling portion of its overrunning clutch.

A second object of the present invention is to provide a starter system for an internal combustion engine which can improve the capability to keep off water and dust from the overrunning clutch and the reduction gear unit.

A third object of the present invention is to provide a starter system for an internal combustion engine which can not only prevent intrusion of water into the starter system, but also quickly expel water out of the starter system should water get into the casing of the starter system.

These and other objects of the present invention can be accomplished by providing a starter system for an internal combustion engine, comprising: an electric motor having an output shaft; a reduction gear unit having an input end coupled to the output shaft of the electric motor and an output shaft projecting from the reduction gear unit in a coaxial relationship with the output shaft of the electric motor; a reduction gear unit casing generally covering the reduction gear unit and provided with a cylindrical boss portion surrounding the output shaft of the reduction gear unit, the boss portion defining a cylindrical outer surface coaxial with the output shaft of the reduction gear unit; an overrunning clutch having an input member coupled to the output shaft of the reduction gear unit and axially slidably, but non-rotatably, mounted on the output shaft of the reduction gear unit, an output member carrying a pinion thereon coaxially with the output shaft of the reduction gear unit, and overrunning means for disconnecting coupling between the input member and the output member when a rotational speed of the output member is higher than that of the input member; and shift means for actuating the input member of the overrunning clutch in a direction to axially move the pinion into mesh with a ring gear of an internal combustion engine; the input member of the overrunning clutch being provided with an annular shoulder surface abutting an annular end surface of the cylindrical boss portion of the reduction gear unit casing when the overrunning clutch is at a rest position, and a cylindrical sleeve portion extending from the annular shoulder surface towards the reduction gear unit and adapted to be closely fitted on the cylindrical boss portion of the reduction gear unit casing.

Thus, intrusion of water and dust into the spline coupling portion can be prevented because the annular shoulder surface of the input member of the overrunning clutch and the annular end surface of the reduction gear unit cover abut each other over an entire circumference when the starter system is at its rest position, and further because of the provision of the cylindrical sleeve portion of the input member of the overrunning clutch and the cylindrical boss portion of the reduction gear unit casing which are fitted one over the other. In particular, when the starter system is activated and centrifugal force is present, even when the annular shoulder surface of the input member of the overrunning clutch is moved away from the annular end surface of the reduction gear unit cover, the water is prevented from reaching the vicinity of the gap between the annular shoulder surface and the annular end surface.

According to a preferred embodiment of the present invention, an annular recess is defined in the outer circumferential surface of the cylindrical sleeve portion of the input member of the overrunning clutch to engage a part of the shift means such as a bifurcated yoke member, for axially actuating the overrunning clutch. This structure contributes to the reduction in the overall length of the starter system through double utilization of the cylindrical sleeve portion.

According to an embodiment of the present invention, the starter system further comprises a pinion cover attached to an output shaft end of the electric motor, covering the reduction gear unit casing, the overrunning clutch and the pinion, a base end of the pinion cover being provided with a cylindrical mounting portion adapted to be received in an associated mounting bore provided in an internal combustion engine or a transmission case, the mounting bore being provided with a recess or a notch communicating with the outside, a bottom end of the pinion cover being provided with a through hole having an external opening end facing a wall surface of the recess or notch of the mounting bore.

Thus, since the outer opening end of the water draining hole faces the outer wall surface of the recess or a notch located between the mounting bore of the engine and the mounting flange portion, it becomes possible to cover the outer end of the water draining hole with the wall surface of the engine and, by crossing the axial direction of the water draining hole and the extending direction of the engine outer wall surface and/or reducing the gap between the engine outer wall surface and the outer end of the water draining hole to the greatest a possible extent, water which may be splashed up by the vehicle during its motion can be effectively prevented from entering the interior of the starter through this water draining hole.

According to a preferred embodiment of the present invention, the output member constructed as a clutch inner member is provided with a first radial flange adjacent the pinion and a second radial flange adjacent the overrunning clutch means. Preferably, the input member of the overrunning clutch is covered by a clutch casing, the clutch casing being provided with a radial internal flange on an end surface thereof facing the pinion and having a peripheral inner edge opposing an associated peripheral outer edge of the second annular flange of the output member.

Thus, the water adhering to the pinion can be dropped off from the first flange portion, the water adhering to a part intermediate between the two flange portions is dropped off from the two flange portions, and the remaining water is expelled from the two flange portions by centrifugal force, whereby intrusion of water from the pinion to the interior of the overrunning clutch can be effectively prevented.

BRIEF DESCRIPTION OF THE DRAWINGS

Now the present invention will be described with reference to the appended drawings, in which.

DETAILED DESCRIPTION OF THE PREFERRED EMBODIMENTS

Figure 1:
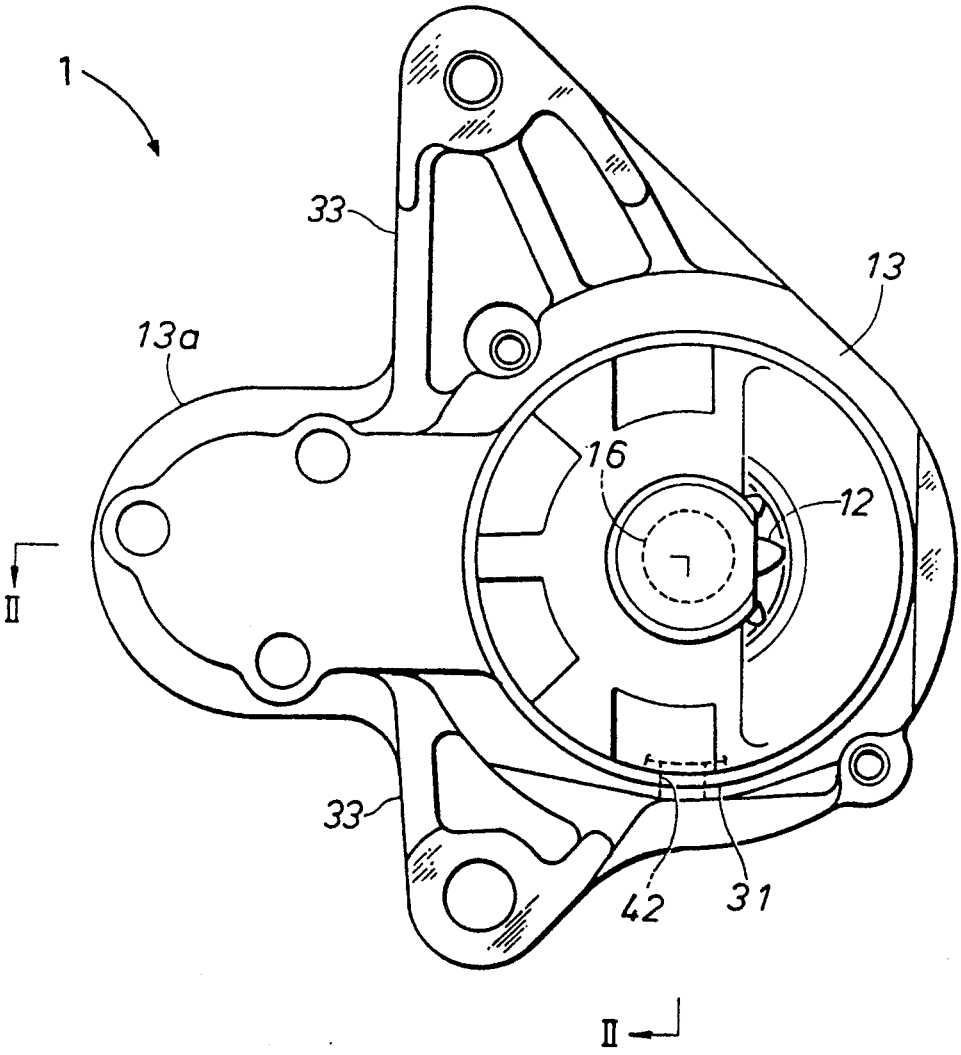
FIG. 1 is a front view of an embodiment of the starter system for an internal combustion engine according to the present invention.
Figure 2:
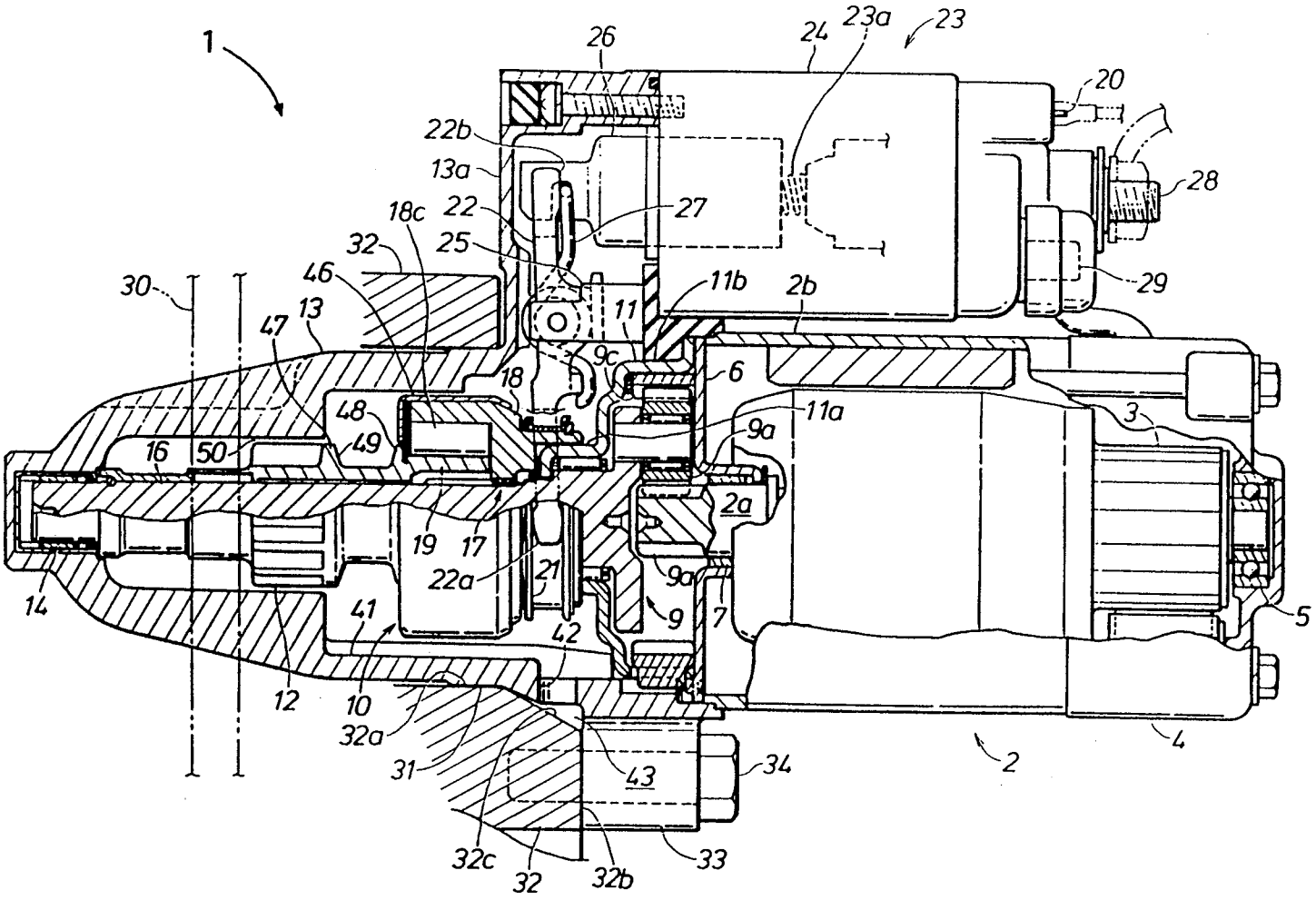
FIG. 2 a sectional view taken along line II—II of FIG. 1.

FIGS. 1 and 2 generally show a starter 1 equipped with a reduction gear unit given here as an embodiment of the starter system for an internal combustion engine according to the present invention, and this starter 1 powered by a DC motor 2 produces a rotational power for cranking an internal combustion engine. As seen in FIG. 2, the right end of the motor shaft 2*a* of the DC motor 2 is rotatably supported by a ball bearing 5 secured to an end cover 4 covering a commutator 3, and the left end of the motor shaft 2*a* is supported by a metal bearing 7 secured to a separator 6 serving as an end plate of the motor 2.

Figure 3:
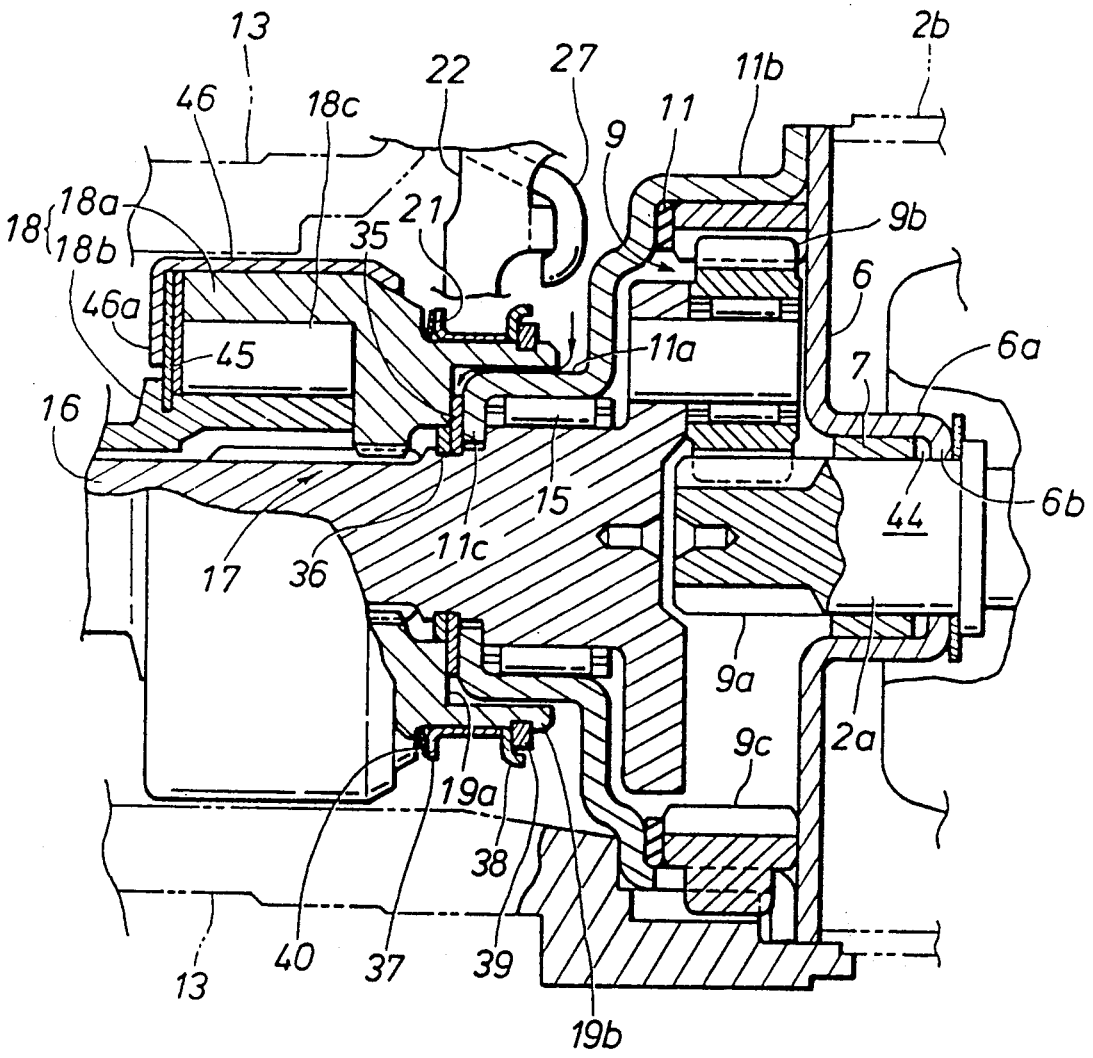
FIG. 3 is an enlarged sectional view of a part of FIG. 2.

To the left side of the motor shaft 2*a* as seen in FIG. 2 is provided a planetary gear unit 9 serving as a reduction gear unit, and a sun gear 9*a* mounted on the left free end of the motor shaft 2*a*. Planetary gears 9*b* mesh with the sun gear 9*a* as shown in FIG. 3. On the left end of the separator 6 is placed a center bracket 11 defined with a small axial cylindrical portion 11*a* and a large axial cylindrical portion 11*b* as best illustrated in FIG. 3. The larger cylindrical portion 11*b* of the center bracket 11 fixedly receives an internal gear 9*c*, and the planetary gear unit 9 is received in the space defined between the separator 6 and the center bracket 11.

The separator 6 and the center bracket 11 are fixedly secured between a pinion cover 13 serving as a casing for receiving a pinion 12, which is described hereinafter, and a casing 2*b* of the motor 2. The two ends of a drive shaft 16 are supported by a metal bearing 14 fixedly secured to the left free end of the pinion cover 13, as seen in FIG. 2 and a roller bearing 15 fitted in the smaller cylindrical portion of the center bracket 11, coaxially with the motor shaft 2*a* as seen in FIG. 3. The planetary gears 9*b* are pivotally supported by a radial flange portion provided at the right end of the drive shaft 16, as seen in FIG. 3, and received in the center bracket 11.

A clutch outer member 18*a* serving as the input end of the overrunning clutch 18 consisting of a one-way roller clutch is coupled to the outer circumferential surface of an intermediate part of the drive shaft 16 by way of a spline coupling portion 17 consisting of a helical spline. A clutch inner member 18*b* serving as the output end of the overrunning clutch 18 is rotatably and axially slidably fitted on the drive shaft 16. A plurality of rollers 18*c* are interposed between the clutch outer and inner members 18*a* and 18*b* to serve as overrunning means as well known in the art.

The pinion 12 for driving a ring gear 30 of an internal combustion engine is integrally formed in the axially left end of the clutch inner member 18*b* as seen in FIG. 2. The clutch outer member 18*a* is provided with an annular recess 21 around its circumference, and a bifurcated working end or a yoke 22*a* of a shift lever 22 engages with this annular recess 21. The shift lever 22 is received in a radially extending peninsular portion 13*a* integrally formed with the pinion cover 13, and a middle part of the shift lever 22 is pivotally supported by a support bracket 25 interposed between the peninsular portion 13*a* and an electromagnetic yoke 24 of an electromagnetic switch 23 connected to the peninsular portion 13*a*.

A plunger 26 of the electromagnetic switch 23 is engaged by a free end of a spring 27 which is supported by the support bracket 25 at an intermediate part thereof and engaged to a part of the shift lever 22 intermediate between the pivot shaft and the yoke 22*a*. The free end 22*b* of the shift lever 22 remote from the yoke 22*a* is also bifurcated, and is elastically engaged to the end of the spring 27 adjacent the plunger 26. The thus constructed shift means allows the rotative motion of the shift lever 22 according to the movements of the plunger 26 under the attractive force of the electromagnetic switch 23 when it is energized, and the restoring force of a return spring 23*a* in the electromagnetic switch 23 when the latter is not energized.

A battery connecting terminal 28 of the electromagnetic switch 23 is electrically connected to a battery not shown in the drawings, and a switch terminal 20 is electrically connected to an ignition switch not shown in the drawings, while a motor connection terminal 29 is electrically connected to the motor 2.

When the ignition switch is turned to the starter-on position, the electromagnetic switch 23 is energized, thereby causing the plunger 26 to be attracted thereto and the shift lever 22 to be rotated in clockwise direction in the sense of FIG. 2 by way of the spring 27. As the yoke 22*a* of the shift lever 22 pushes out the clutch outer member 18*a*, causing it to rotate by means of the spline coupling portion 17 provided in the drive shaft 16, the pinion 12 on the clutch inner member 18*b* comes into mesh with the ring gear 30 of the engine. The attracted movement of the plunger 26 causes an internal contact set to be closed and thereby the motor 2 to be rotated, and the rotation of the motor 2 is reduced in speed by the planetary gear unit 9 and is transmitted to the pinion 12 which drives the ring gear 30 and cranks the engine.

When the engine is finally started and the ignition switch is turned to the starter-off position to thereby bring the coil of the electromagnetic switch 23 to its de-energized state, the return spring 23*a*, serving as the biasing means, electrically urges the plunger 26 to its initial position in its projecting direction.

Since, even when the plunger 26 has been activated, but the pinion 12 has failed to mesh with the ring gear 30 by the striking the end surface of the gear teeth of the ring gear 30, the plunger 26 can be completely attracted by the electromagnet on account of the deflection of the spring 27, the contact set of the electromagnetic switch 23 is closed in any case and the motor 2 is rotated so that the pinion 12 can continue to be rotated by the motor 2, and can eventually mesh with the ring gear 30 in a reliable manner.

A part of the pinion cover 13 of the thus constructed starter 1 adjacent its base end, on the left hand side of FIG. 2, is provided with a cylindrical mounting portion 31 which has an outer circumferential surface coaxial with the drive shaft 16 and adapted to be fitted into a corresponding bore 32*a* provided in a transmission case 32 of the engine for mounting the starter 1 thereon. The base end of the pinion cover 13 is provided with a mounting flange portion 33 so that the starter 1 may be secured on the transmission case 32 by fitting the cylindrical mounting portion 31 into the mounting bore 32*a*, contacting the flange portion 33 to the corresponding mounting surface 32*b* of the transmission case 32, passing threaded bolts through bolt passing holes provided in the mounting flange portion 33, and fastening the same to the transmission case 32, by way of threaded holes provided therein. Depending on the type of the engine, the mounting bore 32*a* may also be provided in the engine itself.

As best illustrated in FIG. 3, the smaller cylindrical portion 11*a* of the center bracket 11 is provided with a radial internal flange 11*c* which covers an axial end surface, facing the overrunning clutch 18, of the roller bearing 15 received therein, and a planar washer 35 is fitted onto the drive shaft 16, interposed between the radial internal flange 11*c* and an annular shoulder surface 19*a* of the clutch outer member 18*a*, and prevented from axially coming off by a stop ring 36. FIGS. 2 and 3 illustrate the overrunning clutch 18 at its rest position with the starter 1 in its non-operative condition, and the clutch outer member 18*a* urged toward the center bracket 11, via the shift lever 22, by the return coil spring 23*a* in the electromagnetic switch 23 biasing the plunger 23 to its rest position.

Thus, since the planar washer 35 is elastically interposed between the annular shoulder surface 19*a* of the clutch outer member 18*a* and the radial internal flange 11*c* of the center bracket 11, and the annular shoulder surface 19*a* thereby elastically abuts the planar washer 35 serving as a fixed stopper surface over its entire circumference, the spline coupling portion 17 is effectively shut off from the outside. Therefore, as shown by the arrow in FIG. 3, the water and dust which would otherwise infiltrate into the spline coupling portion 17 is shut out at the region of abutment, and a sufficient water and dust prevention can be ensured for the spline coupling portion 17.

Furthermore, since a cylindrical sleeve portion 19*b* extending from the periphery of the annular shoulder surface 19*a* towards the planetary gear unit 9 closely surrounds the small diameter portion 11*a*, the possibility of any moisture reaching the vicinity of the annular shoulder surface 19*a* is minimized when the overrunning clutch 18 is at its rest position.

When the electric motor 1 is activated and the overrunning clutch 18 is brought to its operative position, causing the annular shoulder surface 19*a* to be moved away from the radial internal flange 11*c* of the center bracket 11, the water which may be attached to the cylindrical sleeve portion 19*b* and other parts of the clutch outer member 18*a* is thrown radially away from the clutch outer member 18*a*, and is positively prevented from reaching the spline coupling portion 17.

As shown in FIG. 2, since the distance between the axial free end of the clutch inner member 18*b* and the spline coupling portion 17 is sufficiently long and a slide bearing is formed in this portion, infiltration of water from the end of the pinion 12 is highly unlikely.

In this starter 1, the edge along the inner periphery of the radial internal flange 11*a* of the center bracket 11 is brought to the corresponding outer circumferential surface of the drive shaft 16 as close as possible, intrusion of water and dust from the gap between the inner circumference of the radial internal flange 11*a* and the outer circumferential surface of the drive shaft 16 into the planetary gear unit 9 can be effectively prevented.

The annular recess 21 provided in the clutch outer member 18*a* is defined by a shift collar 37 having an L-shaped cross section and fitted onto the outer circumferential surface of the cylindrical sleeve portion 19*b* of the clutch outer member 18*a*, and a shift washer 38. The shift collar 37 and the shift washer 38 are prevented from axially coming off by a C-ring 39, and, further, the shift washer 38 is bent along its outer circumference so as to cover the outer circumference of the C-ring 39, as shown in FIG. 3, and prevent the C-ring 39 from being expanded and coming off under the centrifugal force acting thereon. A damper spring 40 consisting of a wavy dish spring is interposed between an annular shoulder surface on the base end of the cylindrical sleeve portion 19*b* of the clutch outer member 18*b* and the shift collar 37. This damper spring 40 serves as a cushion when the starter 1 is activated and the pinion 12 strikes upon the ring gear 30.

A cylindrical portion 6*a* of the separator 6 supporting the metal bearing 7 is provided with a radial internal flange 6*b* on its surface facing the armature as shown in FIG. 3. A certain gap 44 is defined between the metal bearing 7 and the flange 6*b*. This allows the grease which may come out of the planetary gear unit 9 to be prevented from entering the motor 2 through the metal bearing 7 by storing the grease in the gap 44.

Thus, according to the above-described structure, since the spline coupling portion of the overrunning clutch can be shut out from the outside by the simple structure for abutting an annular shoulder surface of the overrunning clutch to a stopper surface defined in the center bracket serving as a reduction gear unit cover in its rest position, the capability to shut off water and dust from the spline coupling portion can be ensured.

As shown in FIG. 2, an axial groove 41 is formed in a part of the inner circumferential surface of the pinion cover 13 which is situated at a bottom end when the starter 1 is mounted on the engine, and a bottom portion of the axial groove 41 is provided with a water draining hole 42 communicating the interior of the pinion cover 13 with an exterior part of the starter 1 or, more specifically, a notch or a recess 43 defined in the mounting bore 32*a* between the base end of the cylindrical mounting portion 31 and the flange portion 33. This water draining hole 42 faces a wall surface 32*c* of the recess 43 when the starter 1 is mounted on the transmission case 32. Therefore, the water which may be splashed up by the vehicle during its motion is prevented from directly reaching the interior of the pinion cover 13 through the water draining hole 42, and intrusion of water from outside through the water draining hole 42 can be thus effectively prevented.

Also, according to the above described structure, since the water which has entered the pinion cover 13 from the ring gear 30 end is expelled to the outside from the water draining hole 42 via the groove 41, the center bracket 11 of the planetary gear unit 9 is effectively protected from the influence of water, and the capability of the planetary gear unit 9 to withstand water is improved.

According to this starter, the end surface of the overrunning clutch 18 facing the pinion 12 is covered by a clutch washer 45, and a clutch cover 46 is fixedly secured around the outer circumferential surface of the clutch outer member 18*a*, and a region extending from the outer circumferential surface of the clutch outer member 18*a* to the radially intermediate part of the clutch washer 45 is covered by a radial internal flange portion 46*a* of the clutch cover 46. The outer circumferential surface of the clutch inner member 18*b* between the pinion 12 and the rollers 18*c* serves as the overrunning means and is provided with a circumferential recess 49 defined by a radially external first flange portion 47 integrally formed on the end surface of the pinion 12 facing the clutch outer member 18*a*, and a radial external second flange portion 48 adjoining the clutch outer member 18*a*.

The first flange portion 47 has the same diameter as the outer diameter of the pinion 12. The second flange portion 48 rises from a part closer to the pinion 12 than the internal flange 46*a* of the clutch cover 46 and its outer circumferential edge opposes the inner circumferential edge of the internal flange 46*a* of the clutch cover 46 defining a small gap therebetween with its thickness extending axially across the end surface of the clutch outer member 18*a* facing the pinion 12. The clutch washer 45 is retained by the second flange portion 48 and the internal flange portion 46*a* of the clutch cover 46.

As described above, because the recess 49 is defined by the two flange portions 47 and 48 between the pinion 12 and the overrunning clutch 18, the water which has been splashed up from the ring gear 30 and entered the interior of the pinion cover drops off along the first flange portion 47, and the water received in the recess 49 can drop off along the two flange portions 47 and 48. Since the remaining water can also be expelled from the two flange portions 47 and 48 by centrifugal force as they rotate, intrusion of water into the interior of the clutch can be effectively prevented.

Further, according to the present embodiment, the gap 50 between the outer circumferential surface of the pinion 12, or the first flange portion 47, and the inner circumferential surface of the pinion cover 13 surrounding it is minimized. Therefore, the water which comes flying from the ring gear 30 tends to be clogged up in the narrow gap 50 by its surface tension so that the water is prevented from directly entering the overrunning clutch, and is expelled to the outside through the water draining hole 42. The plunging movement of the pinion 12 when the starter is activated expels the water which is clogged up in the gap 50. Also, the gap 50 is so defined that the above mentioned relationship holds even when the pinion 12 has been pushed out to mesh with the ring gear 30 when the starter is activated, and the wind produced by the rotation of the pinion 12 produces a sealing effect.

Thus, according to the present invention, the water adhering to the ring gear and the region between the two flanges can be kept out of the overrunning clutch, by the flanges and the remaining water can be expelled from the two flanges by centrifugal force as they rotate so that intrusion of water into the overrunning clutch can be effectively prevented.

Although the present invention has been described in terms of a preferred embodiment thereof, it is obvious to a person skilled in the art that various alterations and modifications are possible without departing from the scope of the present invention which is set forth in the appended claims.

What we claimed is:

1. A starter system for an internal combustion engine, comprising:

an electric motor having an output shaft;

a reduction gear unit having an input end coupled to said output shaft of said electric motor and an output shaft projecting from said reduction gear unit in a coaxial relationship with said output shaft of said electric motor;

a reduction gear unit casing generally covering said reduction gear unit and provided with a cylindrical boss portion surrounding said output shaft of said reduction gear unit, said cylindrical boss portion defining a cylindrical outer surface coaxial with said output shaft of said reduction gear unit;

an overrunning clutch having an output member coupled to said output shaft of said reduction gear unit and axially slidably but non-rotatably mounted on said output shaft of said reduction gear unit, an output member carrying a pinion thereon coaxially with said output shaft of said reduction gear unit, and overrunning means for disconnecting coupling between said input member and said output member when a rotational speed of said output member is higher than that of said input member; and shift means for actuating said input member of said overrunning clutch in a direction to axially move said pinion into mesh with a ring gear of an internal combustion engine;

said input member of said overrunning clutch being provided with an annular shoulder surface abutting an annular end surface of said cylindrical boss portion of said reduction gear unit casing when said overrunning clutch is at a rest position, said annular end surface defined by a radial internal flange extending from a free end of said cylindrical boss portion, and a cylindrical sleeve portion extending from said annular shoulder surface towards said reduction gear unit and adapted to be closely fitted on said cylindrical boss portion of said reduction gear unit casing;

an annular washer fitted on and secured to a portion of said output shaft of said reduction gear unit so as to be interposed between said annular shoulder surface of said clutch input member and said annular end surface of said reduction gear unit casing.

2. A starter system according to claim 1, wherein an annular recess is defined in an outer circumferential surface of said cylindrical sleeve portion, and said shift means includes a bifurcated yoke which engage with said annular recess for axially actuating said overrunning clutch.

3. A starter system according to claim 1, wherein said reduction gear unit casing comprises a stamp formed end plate.

4. A starter system according to claim 1, further comprising a pinion cover attached to an output shaft end of said electrical motor, covering said reduction gear unit casing, said overrunning clutch and said pinion, a base end of said pinion cover being provided with a cylindrical mounting portion adapted to be received in an associated mounting bore provided in an internal combustion engine or a transmission case, said mounting bore being provided with a recess or a notch communicating with the outside, a bottom end of said pinion cover being provided with a through hole having an external opening end facing a wall surface of said recess or notch of said mounting bore.

5. A starter system according to claim 1, wherein said output member is provided with a first radial flange adjacent said pinion and a second radial flange adjacent said overrunning means.

6. A starter system according to claim 5, wherein said input member of said overrunning clutch comprises a clutch outer member covered by a clutch casing, said clutch casing being provided with a radial internal flange on an end surface thereof facing said pinion and having a peripheral inner edge opposing an associated peripheral outer edge of said second radial flange of said outer member.

7. A starter system for an internal combustion engine, comprising:

an electric motor having an output shaft;

a reduction gear unit having an input end coupled to said output shaft of said electric motor and an output shaft projecting from said reduction gear unit in a coaxial relationship with said output shaft of said electric motor;

a reduction gear unit casing generally covering said reduction gear unit and provided with a cylindrical boss portion surrounding said output shaft of said reduction gear unit, said cylindrical boss portion defining a cylindrical outer surface coaxial with said output shaft of said reduction gear unit;

an overrunning clutch having an input member coupled to said output shaft of said reduction gear unit and axially slidably but non-rotatably mounted on said output shaft of said reduction gear unit, an output member carrying a pinion thereon coaxially with said output shaft of said reduction gear unit, and overrunning means for disconnecting coupling between said input member and said output member when a rotational speed of said output member is higher than that of said input member; and shift means for actuating said input member of said overrunning clutch in a direction to axially move said pinion into mesh with a ring gear of an internal combustion engine;

said input member of said overrunning clutch being provided with an annular shoulder surface abutting an annular end surface of said cylindrical boss portion of said reduction gear unit casing when said overrunning clutch is at a rest position, and a cylindrical sleeve portion extending from said annular shoulder surface towards said reduction gear unit and adapted to be closely fitted on said cylindrical boss portion of said reduction gear unit casing;

said output member provided with a first radial flange adjacent said pinion and a second radial flange adjacent said overrunning means.

8. A starter system according to claim 7, wherein said input member of said overrunning clutch comprises a clutch outer member covered by clutch casing, said clutch casing being provided with a radial internal flange on an end surface thereof facing said pinion and having a peripheral inner edge opposing an associated peripheral outer edge of said second radial flange of said outer member.

9. A starter system for an internal combustion engine, comprising:

an electric motor having an output shaft;

a reduction gear unit having an input end coupled to said output shaft of said electric motor and an output shaft projecting from said reduction gear unit in a coaxial relationship with said output shaft of said electric motor;

a reduction gear unit casing generally covering said reduction gear unit and provided with a cylindrical boss portion surrounding said output shaft of said reduction gear unit, said cylindrical boss portion defining a cylindrical outer surface coaxial with said output shaft of said reduction gear unit;

an overrunning clutch having an input member coupled to said output shaft of said reduction gear unit and axially slidably but non-rotatably mounted on said output shaft of said reduction gear unit, an output member carrying a pinion thereon coaxially with said output shaft of said reduction gear unit, and overrunning means for disconnecting coupling between said input member and said output member when a rotational speed of said output member is higher than that of said input member, said input member being provided with an annular shoulder surface abutting an annular end surface of said cylindrical boss portion of said reduction gear unit casing when said overrunning clutch is at rest position, and a cylindrical sleeve portion extending from said annular shoulder surface towards said reduction gear unit and adapted to be closely fitted on said cylindrical boss portion of said reduction gear unit casing;

shift means for actuating said input member of said overrunning clutch in a direction to axially move said pinion into mesh with a ring gear of an internal combustion engine; and a pinion attached to an output shaft end of said electric motor, covering said reduction gear unit casing, said overrunning clutch and said pinion and supporting a free end of said output member of said overrunning clutch, a base end of said pinion cover being provided with a cylindrical mounting portion adapted to be received in an associated mounting bore provided in an internal combustion engine or a transmission case, said mounting bore being provided with a recess or a notch communicating with the outside, a bottom end of said pinion cover adjacent an end of said mounting bore facing said electric motor, said bottom end being provided with a through hole having an external opening end facing a wall surface of said recess or notch of said mounting bore.

* * * * *